US006244021B1

(12) United States Patent
Ausnit et al.

(10) Patent No.: US 6,244,021 B1
(45) Date of Patent: Jun. 12, 2001

(54) METHOD OF APPLYING RECLOSABLE ZIPPER TO PACKAGE

(75) Inventors: Steven Ausnit, New York, NY (US); Ronald L. Ramsey, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/316,868

(22) Filed: May 21, 1999

(51) Int. Cl.[7] ..... B65B 61/18

(52) U.S. Cl. ..... 53/412; 53/133.4; 53/139.2; 493/213

(58) Field of Search ..... 53/133.4, 139.2, 53/373.7, 133.6, 133.8, 412; 493/213, 212

(56) References Cited

U.S. PATENT DOCUMENTS 4,240,241 * 12/1980 Sanborn, Jr. ..... 53/133.4
5,035,517 * 7/1991 Edelman ..... 53/133.4
5,105,603 * 4/1992 Natterer ..... 53/133.4
5,519,982 * 5/1996 Herber et al. ..... 53/133.4
5,557,907 * 9/1996 Malin et al. ..... 53/133.4
5,592,802 * 1/1997 Malin et al. ..... 53/133.4
5,788,378 * 8/1998 Thomas ..... 53/133.4
5,826,401 * 10/1998 Bois ..... 53/133.4
5,956,924 * 9/1999 Thieman ..... 53/133.4
6,000,197 * 12/1999 Ausnit ..... 53/133.4

* cited by examiner

*Primary Examiner*—Stephen F. Gerrity
*Assistant Examiner*—Louis K. Huynh
(74) *Attorney, Agent, or Firm*—Pitney, Hardin, Kipp & Szuch LLP

(57) ABSTRACT

A method for attaching reclosable zipper to a package is provided. A pair of opposing film extensions are provided on the package above the seal at the package opening. The reclosable zipper is then inserted between the film extensions on the package and sealed thereto.

22 Claims, 4 Drawing Sheets

METHOD OF APPLYING RECLOSABLE ZIPPER TO PACKAGE

BACKGROUND OF THE INVENTION

1. Field of the Invention

The present invention relates to the field of reclosable packaging. More particularly, the present invention relates to a method of applying reclosable zippers to packages previously made on horizontal form-fill-seal OFFS) machines and vertical form-fill-seal (VFFS) machines.

2. Description of the Prior Art

Reclosable packages made on HFFS and VFFS machines are well known in the prior art. For example, U.S. Pat. No. 4,876,842 discloses a method of manufacturing reclosable packages on an HFFS machine, while U.S. Pat. Nos. 4,909,017, 4,655,862 and 4,894,975 disclose methods of manufacturing reclosable packages on VFFS machines.

These prior art methods, however, have proven unsatisfactory in certain circumstances. In particular, the disclosed methods are fairly complex in that they call for attachment of the reclosable zippers to the package material during formation, filling and sealing of the packages. This complexity in turn often necessitates the use of complex and expensive machinery in practice.

SUMMARY OF THE INVENTION

The object of the present invention, therefore, is to provide a simplified method for attaching reclosable zippers to packages made on HFFS and VFFS machines.

This object is achieved in that the reclosable zippers are attached to the packages after the packages are formed, filled and sealed by the HFFS or VFFS machine, rather than during package forming, filling and sealing as disclosed in the prior art. Essentially, a pair of opposing film extensions are provided on each package above the seal at the package opening. Reclosable zippers are then inserted between the film extensions on the packages and sealed thereto. In this manner the reclosable zippers may easily be attached to the packages after the packages have been formed, filled and sealed.

DETAILED DESCRIPTION OF THE PREFERRED EMBODIMENT

The present invention will now be described in detail, with frequent reference being made to the accompanying drawings in which identical numerals represent identical elements.

Figure 1:
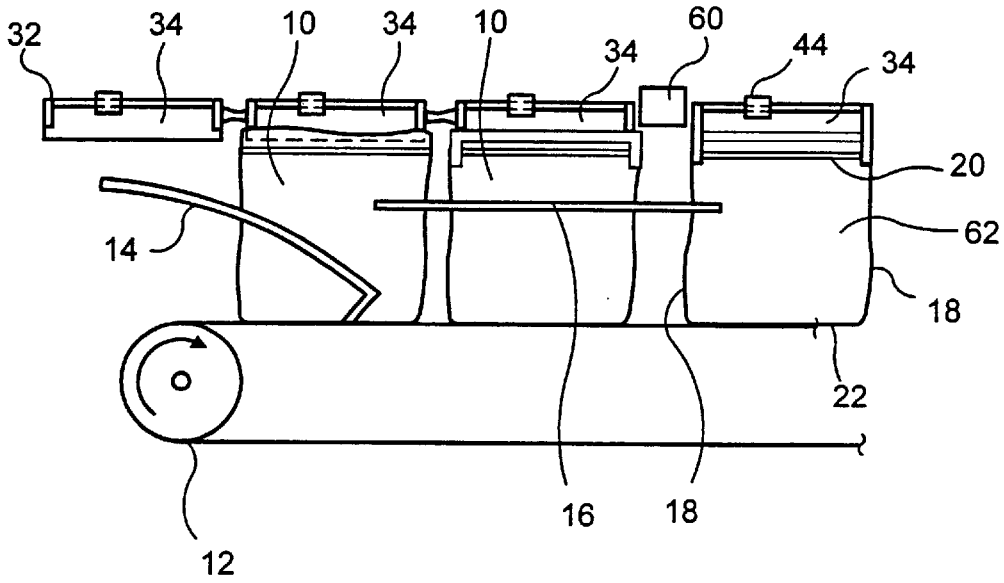
FIG. 1 shows reclosable zippers being attached to packages in accordance with a first embodiment of he present invention.

FIG. 1 shows a series of individual packages 10 being moved along in a direction (to the right) by a transport mechanism 12, such as a conveyor belt. The individual packages are made of thermoplastic film, or any suitable packaging material, and somewhere upstream were formed, filled and sealed on either an HFFS or VFFS machine (not shown). The packages 10 are guided by two guides 14, 16 which ensure that the packages 10 remain in upright and stabilized positions.

Each package 10 is provided with a cross-seal 18 on either side and a peel seal 20 at the package mouth. Depending on how the package was formed in the HFFS or VFFS machine, the package may also have a bottom seal 22.

Figure 2:
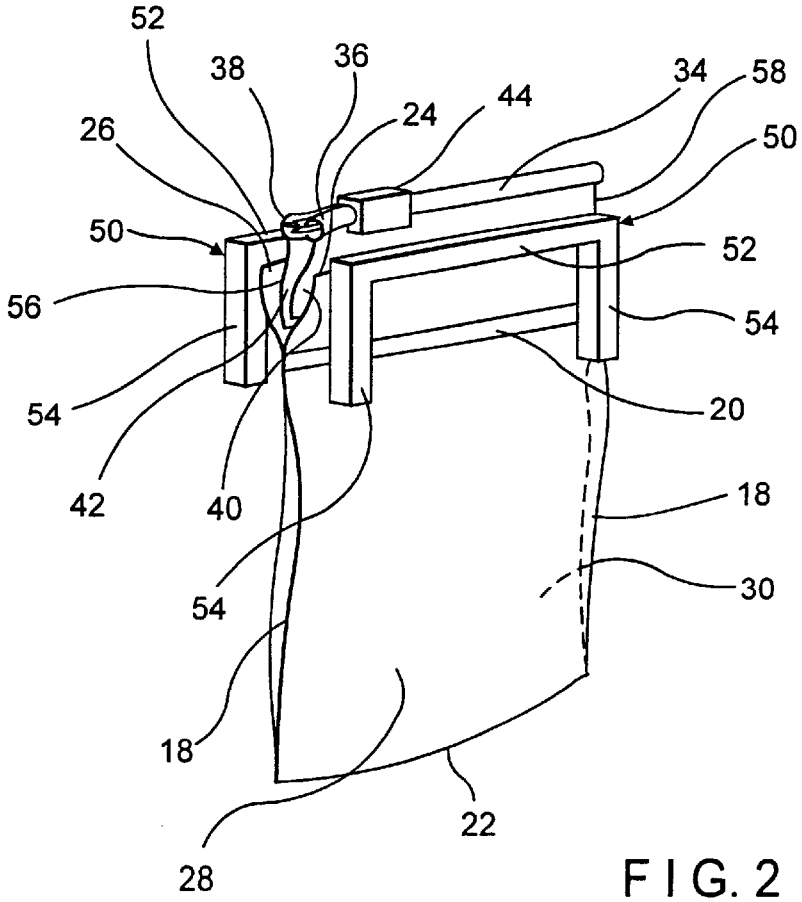
FIG. 2 shows a perspective view of a reclosable zipper being sealed to a package in accordance with the first embodiment of the present invention.

As shown in FIG. 2, each package has first and second film extensions 24, 26 which extend upwardly above the peel seal. The extensions 24,26 are part of first and second package walls 28,30, respectively. The extensions 24,26 are not sealed to each other and may readily be separated.

As the packages 10 are transported by the conveyor belt 12, a chain 32 of zippers 34 is fed between the extensions 24,26 of the packages 10. The zipper chain 32 may be fed by any one of numerous mechanisms used in the reclosable packaging industry and well-known to those of ordinary skill in the art.

Each zipper 34 includes first and second profiles consisting of interlocking closure elements 36,38 and first and second flanges 40,42 extending from the first and second closure elements 36, 38, respectively. The zipper may also be provided with a slider 44 to facilitate the opening and closing of the zipper 34, if desired.

Figure 3:
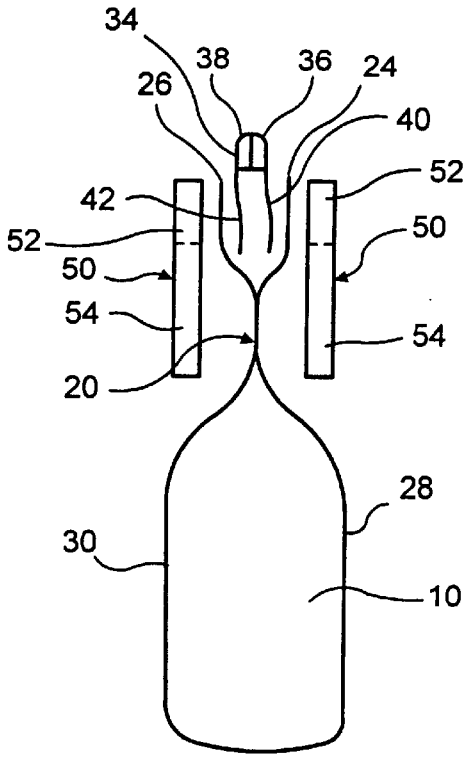
FIG. 3 shows a cross-sectional view of a reclosable zipper being attached to a package in accordance with the first embodiment of the present invention.

After a zipper 34 is fed between the extensions 24, 26 of a given package, the first and second zipper flanges 40,42 are respectively sealed along their lengths to the package extensions 24,26 by horizontal portions 52 of a pair of seal bars 50. Simultaneously, vertical portions 54 of the seal bars 50 make end seals across the zipper ends 56, 58. As shown in FIG. 3, the vertical portions 54 of the seal bars 50 extend beyond the peel seal 20 so as to ensure integrity of the package 10. The vertical seal bar portions 54 also crush and seal the zipper closure elements 36, 38 together at the zipper ends 56, 58 so that the zipper 34 does not come apart during use. Additionally, when a slider 44 is provided, the vertical portions 54 can be configured to provide end stops on the zipper 34 which prevent the slider 44 from sliding off the ends of the zipper. Alternatively, these slider end stops may have been pre-applied.

After the zipper 34 is sealed to the package 10, it is simply cut from the next zipper in the chain 32 at a cutting station 60. A completed package 62 having a reclosable zipper 34 is then removed.

Figure 4:
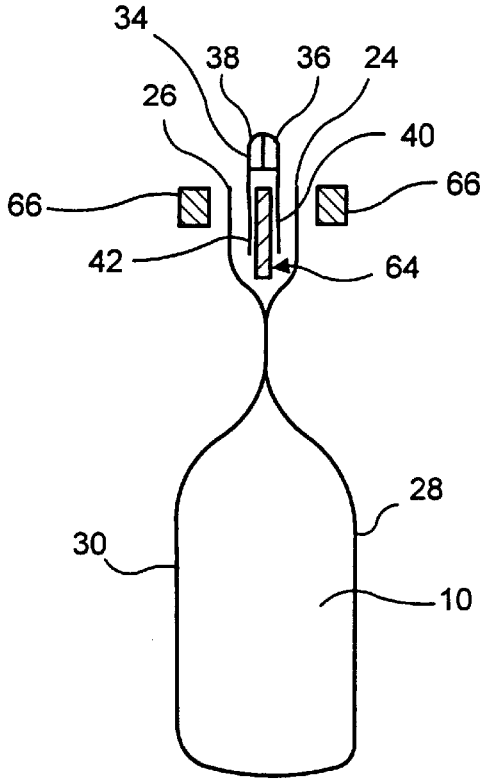
FIG. 4 shows a cross-sectional view of a reclosable zipper being attached to a package in accordance with a variation of the first embodiment of the present invention.

In situations where the zipper chain 32 is difficult to feed, it is advantageous to provide a guide rail for guiding the zipper chain 32 and positioning the zipper chain 32 relative to the bag walls. Such a guide rail 64 is shown in FIG. 4. As shown in FIG. 4, the guide rail is positioned between the zipper flanges 40, 42. A pair of seal bars 66 are then positioned to seal the flanges to the extensions. The guide rail 64 provides the added benefit of ensuring that the zipper flanges 40, 42 will not seal to each other, making it unnecessary to carefully control the sealing temperature. Because of the presence of the guide rail 64, however, it is not possible to simultaneously make the end seals, as in FIG. 3. The end seals must be made at a second sealing station somewhere downstream beyond the guide rail 64.

Figure 5:
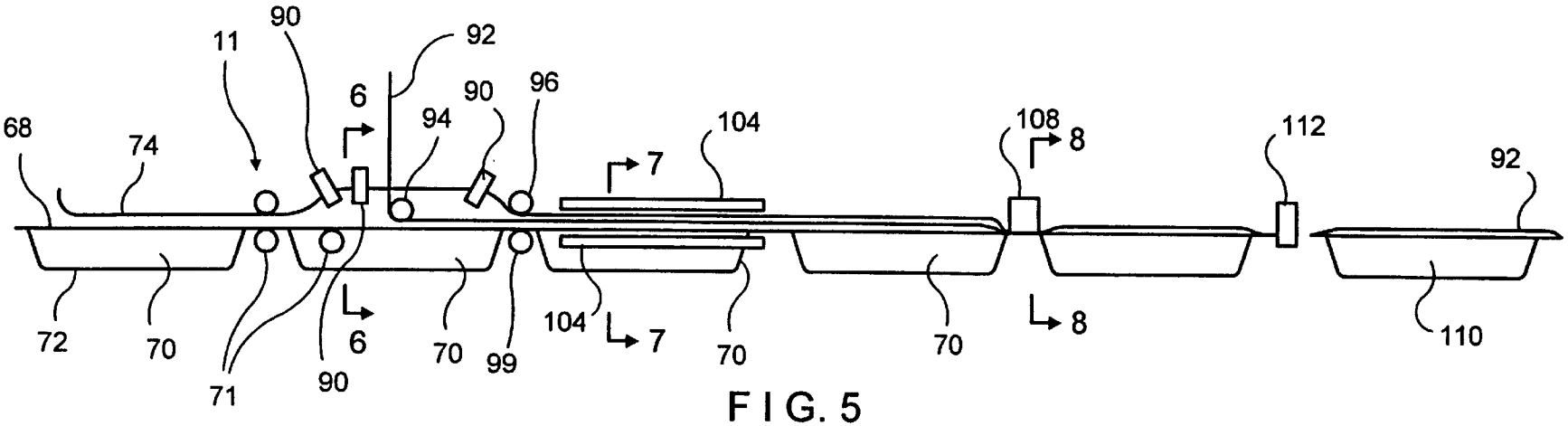
FIG. 5 shows reclosable zippers being attached to a chain of packages in accordance with a second embodiment of the present invention.
Figure 9:
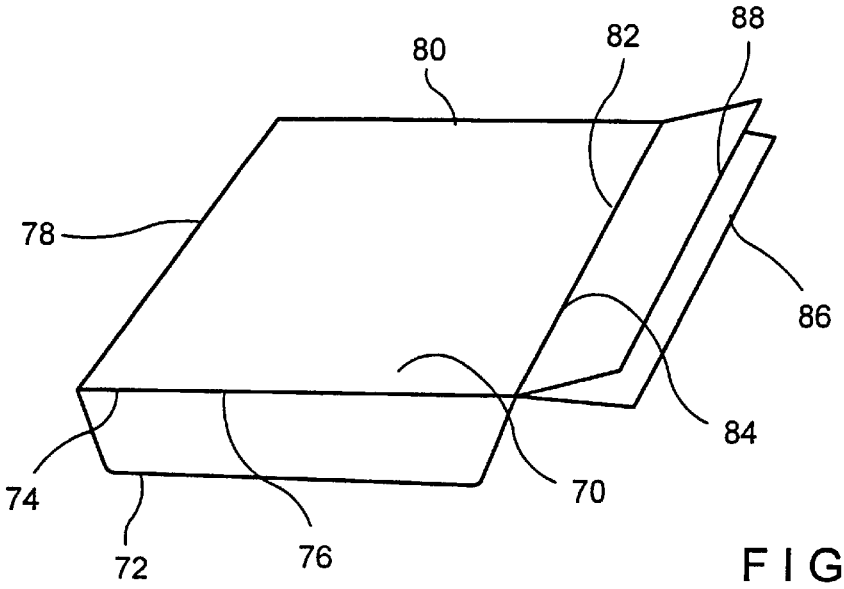
FIG. 9 shows a perspective view of a package in accordance with the second embodiment of the present invention.

It is also possible to attach zippers to a chain of packages, as shown in FIG. 5. A chain 68 of packages 70, such as filled trays, previously made somewhere upstream on a thermoform HFFS machine, or the like, are output from the HFFS machine and moved by a pair of drive rollers 71. Each package 70 is formed from a lower wall 72 sealed to an upper wall 74. As shown in FIG. 9, the upper wall 74 is sealed to the lower wall 72 at four locations 76, 78, 80, 82. The seal 82 at the mouth 84 takes the form of a peel seal. Similar to the package of FIG. 1, wall extensions 86, 88 are provided beyond the peel seal 82. The wall extensions 86, 88 are not sealed to each other and may readily be separated for insertion of a zipper.

Figure 8:
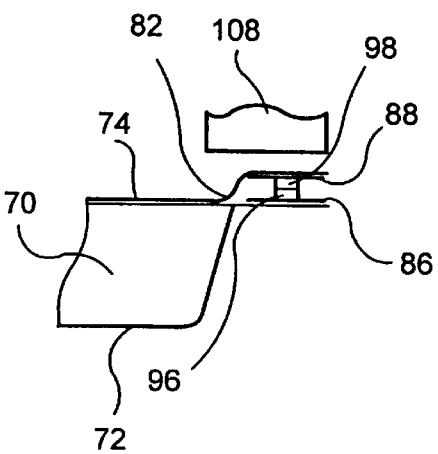
FIG. 8 shows a cross-sectional view of FIG. 5 along line 8—8.
Figure 7:
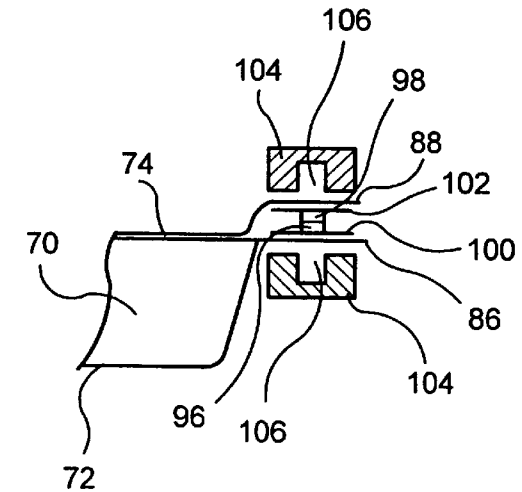
FIG. 7 shows a cross-sectional view of FIG. 5 along line 7—7.
Figure 6:
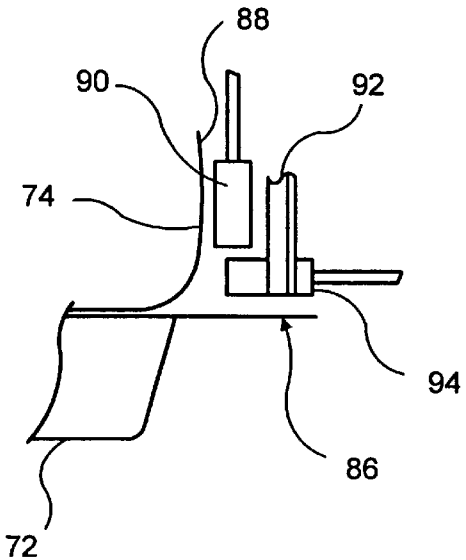
FIG. 6 shows a cross-sectional view of FIG. 5 along line 6—6.

As the chain 68 of packages is output from the HFFS machine and moved by the drive rollers 71, three separating members 90 are provided which separate the wall extensions 86, 88. Then, a continuous supply of reclosable zipper 92 is fed between the separated wall extensions 86, 88. A roller 94 is provided for feeding and guiding the zipper 92 between the web extensions 86, 88. FIG. 6, which is a cross-sectional view along line 6—6 of FIG. 5, shows clearly how the wall extensions 86, 88 are separated and how the zipper 92 is fed therebetween. As shown in FIGS. 7 and 8, the zipper 92 comprises two interlocking closure elements 96, 98 and integral flanges 100, 102 extending on either side thereof. Optionally, the zipper 92 may also be provided with a slider for opening and closing the zipper. In that case the zipper flanges 100, 102 would only extend on one side of their respective interlocking closure elements 96, 98, i.e., towards the package body.

After the zipper 92 is fed between the wall extensions 86, 88, a pair of rollers 99 bring the wall extensions 86, 88 together, enclosing the zipper 92 therebetween. Then, further downstream, a pair of seal bars 104 seal the zipper flanges 100, 102 to the wall extensions 86, 88. FIG. 7, which is a cross-sectional view along line 7—7 of FIG. 5, shows the sealing detail. The seal bars 104 are each provided with a cavity 106 so that the interlocking closure elements are not crushed and/or distorted. If a slider is used, the cavity is enlarged to accommodate it.

After the zipper webs 100, 102 are sealed to the wall extensions 86, 88 of the package, the zipper is spot sealed at its ends by a seal bar 108 to ensure that the zipper does not come apart during use. FIG. 8, which is a cross-sectional view along line 8—8 of FIG. shows this detail. The seal bar 108 extends beyond the peel seal 82 to ensure the integrity of the package 70. Finally, the finished packages 110 are cut from the chain by a cutting mechanism 112 while at the same time cutting the zipper from the continuous supply 92.

Figure 10:
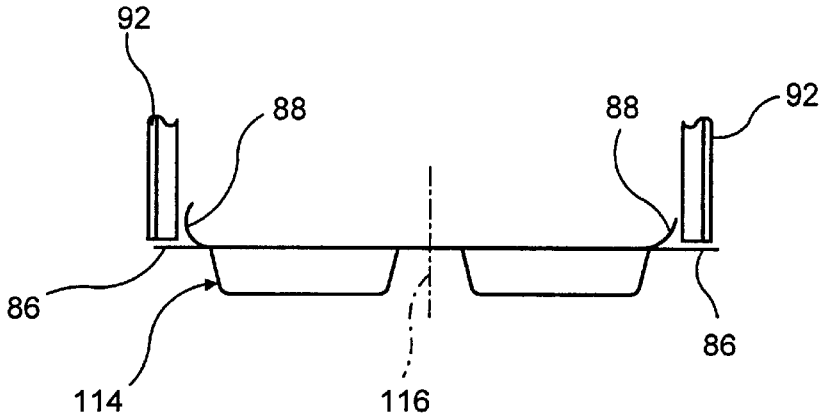
FIG. 10 shows a cross-sectional view of two reclosable zippers being attached to a double package chain in accordance with a first variation of the second embodiment of the present invention.
Figure 11:
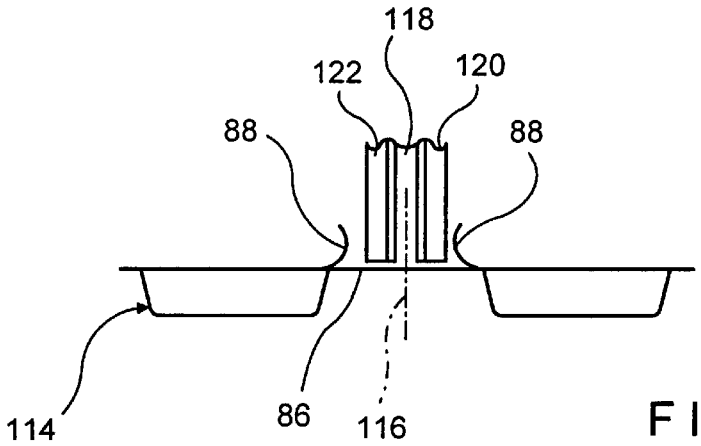
FIG. 11 shows a cross-sectional view of a double reclosable zipper being attached to a double package chain in accordance with a second variation of the second embodiment of the present invention.

It is also possible to attach zippers to a double chain 114 of side-by-side packages joined at a central axis 116 of the chain. There are at least two possible configurations for this double chain. The first configuration, shown in FIG. 10, is where the zippers 92 are sealed to wall extensions 86, 88 on the outside of the trays. The zippers are basically attached to the packages in the manner shown in FIG. 5 (the chain is transported into or out of the page). A second cutting mechanism must be provided to cut the side-by-side trays from each other along the central axis 116 of the double chain 114. The second configuration, shown in FIG. 11, is where the wall extensions 86, 88 are provided along the central axis 116 of the chain 114. In that case a double zipper 118, i.e. two single zippers 120, 122 joined together side-by-side, is inserted between the wall extensions 86, 88 on side-by-side packages. Once again, the zippers are basically attached in the manner shown in FIG. 5 (the chain is transported into or out of the page). However, as in the embodiment of FIG. 10, a second cutting mechanism must be provided to cut the double zipper into two zippers and cut the side-by-side packages from each other along the chain axis 116.

Thus, in the foregoing manner the object of the present invention is achieved. Modifications to the above would be obvious to those of ordinary skill in the art, but would not bring the invention so modified beyond the scope of the appended claims.

We claim:

1. A method of attaching a reclosable zipper to a package, said method comprising the steps of:

providing a package having a bottom, a first wall opposite a second wall and first and second sides at edges of said walls, said walls being joined together at said edges to a first seal spaced apart from said bottom and along said first seal from side to side, a portion of said walls extending a distance above said first seal, said wall portions extending above said first seal being unsealed to one another from side to side of the package;

providing a reclosable zipper having a first closure element of a first profile interlocked with a second closure element of a second profile;

separating said first and second wall portions above said first seal; inserting said reclosable zipper between said separated first and second package wall extending portions; and attaching said first and second profiles to said first and second package wall extending portions, respectively.

2. The method according to claim 1 wherein said first seal is a peel seal.

3. The method according to claim 2 wherein said package is cross-sealed on opposite sides thereof, said cross-seals extending above said peel seal.

4. The method according to claim 1 including the step of guiding said reclosable zipper as it is inserted between said first and second package wall extending portions.

5. The method according to claim 4 wherein said reclosable zipper is guided by a guide rail positioned between opposing first and second zipper flanges.

6. The method according to claim 1 wherein said package walls are sealed to each other on four sides of said package.

7. The method according to claim 1 wherein said reclosable zipper includes a slider for opening and closing said zipper.

8. The method according to claim 1 wherein said first and second profiles are attached to said first and second package wall extending protions via first and second integral zipper flanges extending, respectively from said first and second closure elements.

9. A method of attaching a reclosable zipper to each of a plurality of packages, said method comprising the steps of:

providing a plurality of packages, each of said packages having a bottom, a first wall opposite a second wall, and first and second sides at edges of said walls, said walls being joined together at said edges to a first seal spaced apart from said bottom and along said first seal from side to side, a portion of said walls extending a distance above said first seal, said wall portions above said first seal being unsealed to one another from side to side of the package;

providing a supply of reclosable zipper, said reclosable zipper having a first closure element of a first profile interlocked with a second closure element of a second profile;

separating said first and second wall portions above said first seal;

inserting a portion of reclosable zipper from said reclosable zipper supply between the separated first and second package wall extending portions of a first package; and attaching the first and second closure profiles of said reclosable zipper portion to said first and second package wall extending portions, respectively.

10. The method according to claim 9 wherein said first seal is a peel seal.

11. The method according to claim 10 wherein said packages are cross-sealed on opposite sides thereof, said cross-seals extending above said peel seal.

12. The method according to claim 9 wherein said packages are connected together in a chain.

13. The method according to claim 12 including the step of cutting said first package from said chain after attachment of said reclosable zipper portion.

14. The method according to claim 12 wherein said package chain includes a plurality of side-by-side packages joined along a central axis of said chain.

15. The method according claim 14 including the additional steps of:

providing a second supply of said reclosable zipper;

inserting a portion of reclosable zipper from said second reclosable zipper supply between the first and second package wall extending portions of a second package, said second package being joined side-by-side with said first package along said central axis of said chain; and attaching the first and second closure elements of the reclosable zipper portion from said second reclosable zipper supply to the first and second package wall extending portions, respectively, of said second package.

16. The method according to claim 14 wherein the first package wall extending portions of side-by-side packages are joined together along said central axis of said chain.

17. The method according claim 16 wherein said reclosable zipper is a double zipper and is inserted between and attached to the first and second package wall extending portions of side-by-side packages.

18. The method according to claim 9 including the step of cutting said reclosable zipper portion from said reclosable zipper supply after attachment to said first and second package wall extending portions.

19. The method according to claim 9 wherein said reclosable zipper portion is provided with a slider for opening and closing said reclosable zipper portion.

20. The method according to claim 9 wherein said first and second profiles of said reclosable zipper portion are attached to said first and second package wall extending portions via first and second integral flanges, extending respectively from said first and second closure elements.

21. The method according to claim 9 including the step of guiding said reclosable zipper portion between the separated first and second package wall extending portions of said first package.

22. The method according to claim 9 wherein said packages are in the form of trays.

* * * * *